US005382184A

United States Patent [19]

DiForte, Jr.

[11] Patent Number: 5,382,184

[45] Date of Patent: Jan. 17, 1995

[54] PERSONAL FLOTATION DEVICE IN THE FORM OF AN INFLATABLE BELT

[76] Inventor: Mario P. DiForte, Jr., P.O. Box 8537, Baltimore, Md. 21234

[21] Appl. No.: 132,936

[22] Filed: Oct. 7, 1993

[51] Int. Cl.[6] ..... B63C 9/08

[52] U.S. Cl. ..... 441/108; 441/88

[58] Field of Search ..... 441/89, 106, 108, 113, 441/117, 114–116, 118, 119

[56] References Cited

U.S. PATENT DOCUMENTS

| | | | |
|---|---|---|---|
| Re. 25,398 | 6/1963 | Moran | 441/113 |
| 346,332 | 7/1886 | Vaughan | 441/113 |
| 419,132 | 1/1890 | Wilcox | 441/113 |
| 790,682 | 5/1905 | Friedman | 441/113 |
| 1,448,527 | 3/1923 | Edmonds . | |
| 1,493,664 | 5/1924 | Blum | 441/113 |
| 1,856,632 | 5/1932 | Haines | 441/113 |
| 1,904,767 | 4/1933 | Nakamura | 441/113 |
| 2,001,384 | 5/1935 | Garvey | 441/113 |
| 2,165,300 | 7/1939 | Peterson | 9/19 |
| 2,324,744 | 7/1943 | Ward | 441/108 |
| 2,424,597 | 7/1947 | Werry | 441/113 |
| 2,451,474 | 10/1948 | Craig | 441/113 |
| 2,703,891 | 3/1955 | Mayer | 9/17 |
| 2,784,426 | 3/1957 | Boyle | 441/111 |
| 3,009,175 | 11/1961 | Marston | 441/113 |
| 3,023,932 | 3/1962 | Hennis | 222/5 |
| 3,414,920 | 12/1968 | Beaton | 9/316 |
| 3,727,252 | 4/1973 | Bauermeister | 9/344 |
| 3,760,442 | 9/1973 | DiForte | 9/316 |
| 4,011,614 | 3/1977 | Bell | 9/337 |
| 4,123,814 | 11/1978 | Ettinger | 441/113 |
| 4,176,772 | 12/1979 | Danon | 224/148 |
| 4,360,351 | 11/1982 | Travinski | 441/94 |
| 4,424,043 | 1/1984 | Behl | 441/88 |
| 4,626,221 | 12/1986 | Rocco | 441/108 |
| 4,668,202 | 5/1987 | Scheorer et al. | 441/113 |
| 5,022,879 | 6/1991 | DiForte | 441/113 |
| 5,037,341 | 8/1991 | Howard | 441/89 |

FOREIGN PATENT DOCUMENTS

| | | |
|---|---|---|
| 2573382 | 11/1989 | France . |
| 21257 | of 1899 | United Kingdom . |
| 2068846 | 1/1981 | United Kingdom . |

*Primary Examiner*—Edwin L. Swinehart
*Attorney, Agent, or Firm*—Shlesinger Arkwright & Garvey

[57] ABSTRACT

A personal flotation device comprises an elongate member for encircling the waist of the user and a belt for securing together its end portions. The member includes buoyancy portions adapted to be disposed substantially at the sides and front of the user, thereby to cause the user to be positioned in a face-up and laid-back position in the water.

19 Claims, 5 Drawing Sheets

PERSONAL FLOTATION DEVICE IN THE FORM OF AN INFLATABLE BELT

FIELD OF THE INVENTION

The present invention relates to a personal flotation device that can be worn around the waist of a user in the manner of a belt.

BACKGROUND OF THE INVENTION

With more and more people engaging in water recreations, such as swimming, fishing and boating, incidence of accidents involving drowning have increased. One of the primary reasons for loss of life is that many people refuse or would not consistently wear personal flotation devices (PDF), such as life-vests. Because they are typically bulky and uncomfortable, especially on hot days, not too many people would want to wear them. However, to be effective, a PFD must be worn all the time. Prior art PDFs approved by the U.S. Coast Guard have been limited to life-vests.

There is therefore a need for a PDF that would meet Coast Guard approval and is less bulky and comfortable to wear, thereby encouraging frequent and consistent use.

OBJECTS AND SUMMARY OF THE INVENTION

It is an object of the present invention to provide a personal flotation device (PDF) that would meet the U.S. Coast Guard approval.

It is another object of the present invention to provide a personal flotation device (PDF) that allows relatively free movement for the user.

It is yet another object of the present invention to provide a PFD that is relatively less bulky to wear.

It is still another object of the present invention to provide a PDF that is shaped like a belt and worn like a belt without substantially restricting free movement of the user.

It is yet another object of the present invention to provide a PDF that provides buoyancy to the user even when uninflated.

It is another object of the present invention to provide a PDF that has a relatively greater tendency to position the user in a face-up and laid-back position in the water.

It is still another object of the present invention to provide a PDF that can be used to lift the user from the water during a rescue operation.

In summary, the present invention provides a PDF that is relatively comfortable to wear, less bulky, allows for relatively free movement of the user and would meet U.S. Coast Guard approval.

BRIEF DESCRIPTIONS OF THE DRAWINGS

Figure 8A:
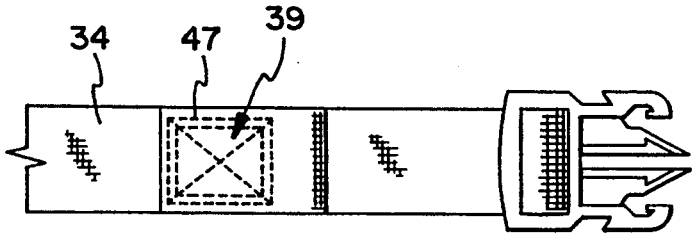

FIG. 8*a* is a detailed plan view of a stop used in the present invention for ensuring that the buckle remains secured to the belt.

Figure 8B:
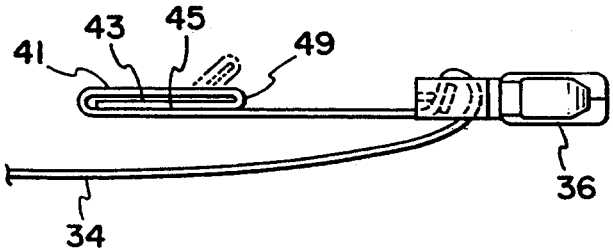

FIG. 8*b* is an edge view of FIG. 8*a*.

DETAILED DESCRIPTION OF THE INVENTION

Figure 1:
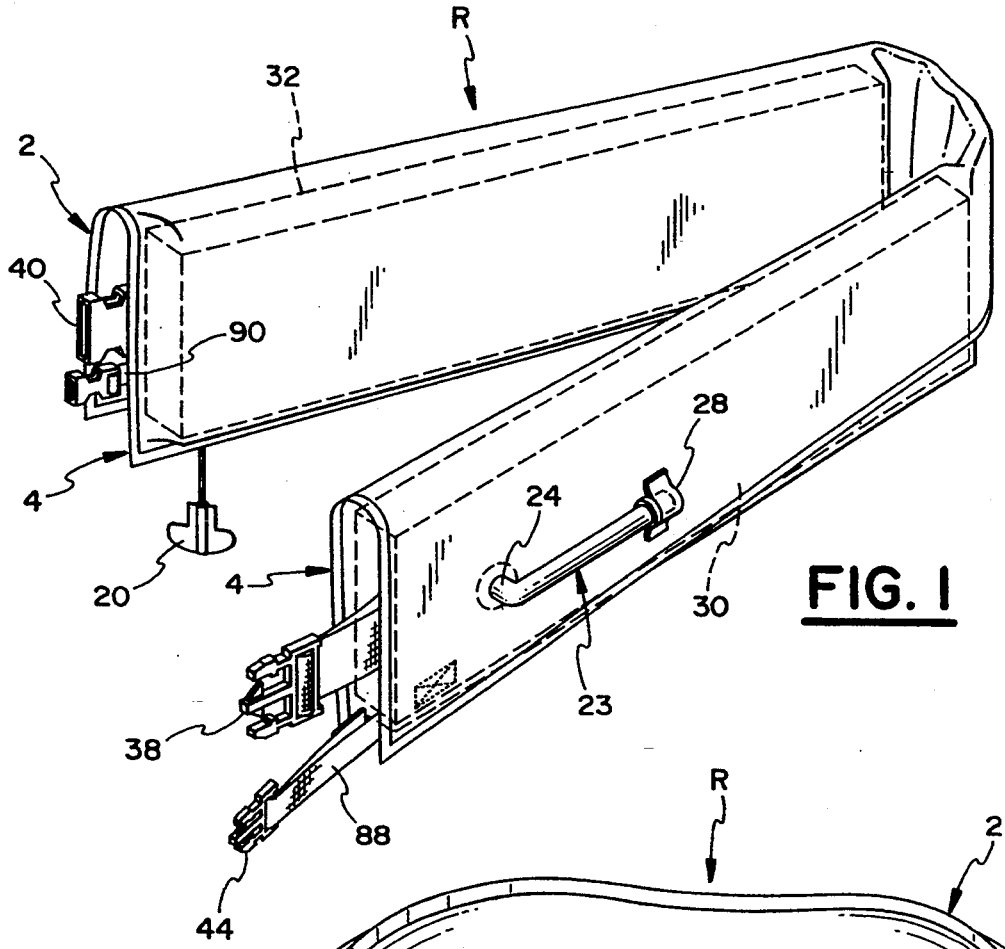
FIG. 1 is a perspective view of a personal flotation device in accordance with the present invention in an uninflated state.
Figure 2:
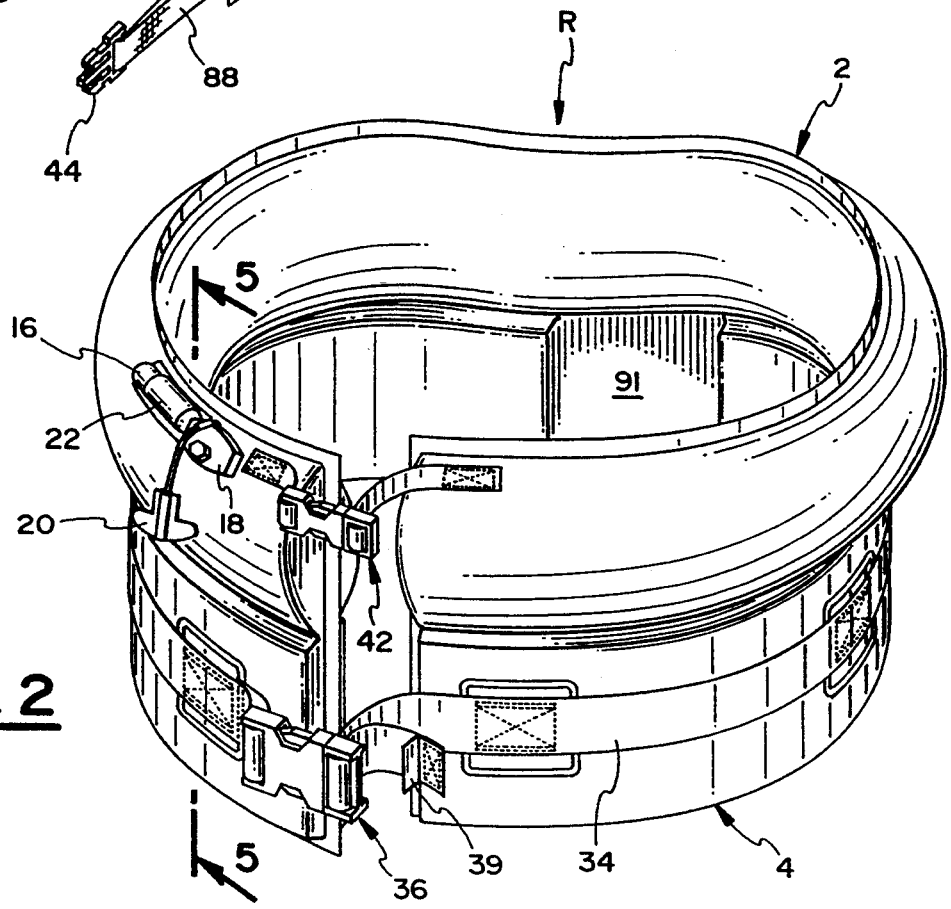
FIG. 2 is a perspective view of the device of FIG. 1 in an inflated state.
Figure 3:
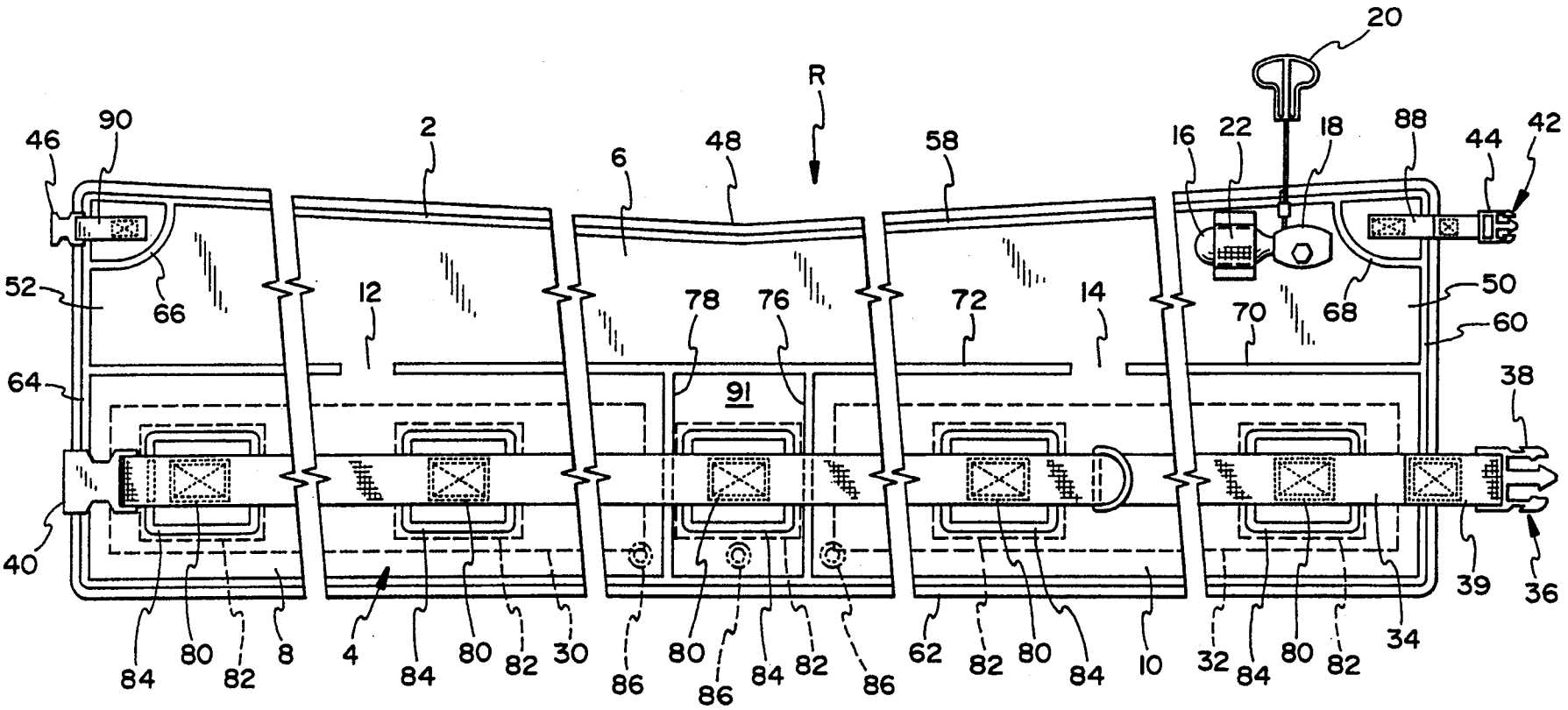
FIG. 3 is a view of the device of FIG. 1 as laid out flat.
Figure 4:
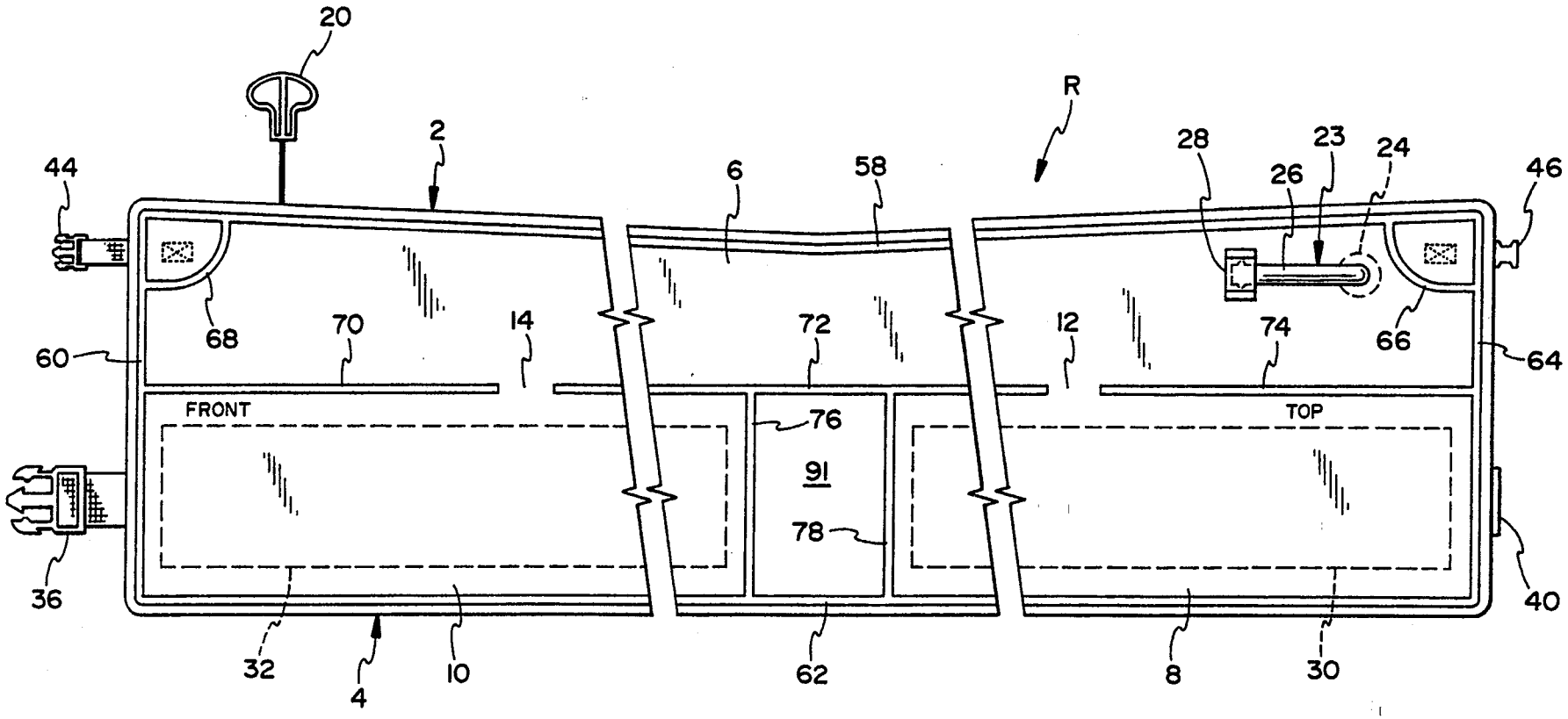
FIG. 4 is an opposite view of FIG. 3.
Figure 5:
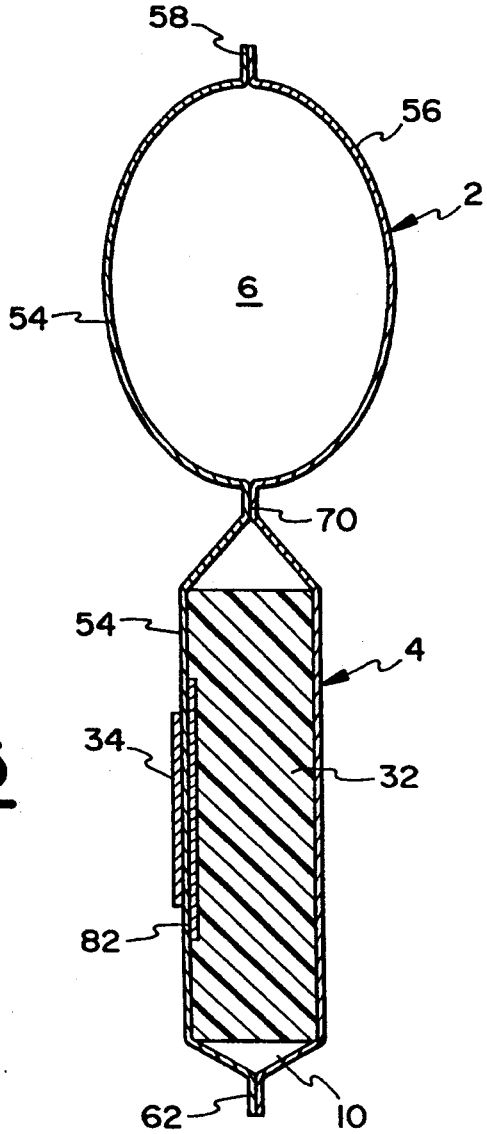
FIG. 5 is a cross-sectional view taken along line 5—5 of FIG. 2.

A personal flotation device R in an uninflated state is disclosed in FIG. 1 and in an inflated state in FIG. 2. The device R is adapted to be worn around the waist of a user, in the manner of a belt, as will be discussed below. The device R has an upper portion 2 and a lower portion 4, as best shown in FIGS. 2, 3 and 4. The upper portion 2 in the uninflated state is foldable along a longitudinal intermediate portion preferably halfway between the upper and lower portions 2 and 4 to overlap the lower portion 4, as best shown in FIG. 1. The upper portion 2 includes an elongate buoyancy chamber 6, as best shown in FIG. 5. The lower portion 4 includes two separate buoyancy chambers 8 and 10, as best shown in FIGS. 4 and 5. The chambers 8 and 10 are preferably in communication with the chamber 6 through passageways generally indicated at 12 and 14, as best shown in FIG. 3. Alternatively, the chamber 6 may be completely isolated and independent from the chambers 8 and 10, where the passageways at 12 and 14 are closed off.

The chamber 6 is inflatable, as best shown in FIGS. 2 and 5. A compressed gas bottle connected to a valve 18 that is in communication with the chamber 6 provide means for inflating the chamber 6. A pull tab 20 is preferably associated with the valve 18 that is effective in releasing the compressed gas into the chamber 6 when the pull tab 20 is pulled. The compressed gas bottle 16 is advantageously replaceable. U.S. Pat. No. 5,022,879 discloses a compressed gas bottle and valve arrangement as used in the present invention. A U-shaped flexible strap 22 removably supports the gas bottle 16 to the upper portion 2.

A manual inflation means 23 with a valve 24 operably connected to a blow tube 26 is operably associated with the chamber 6 to provide supplemental or backup inflation means in the event the compressed gas bottle 16 or the valve 18 fails. A U-shaped flexible strap 28 removably secures one end of the blow tube 26 to the upper portion 2, as best shown in FIG. 4.

The chambers 8 and 10 each encloses foam blocks 30 and 32, respectively, as best shown in FIGS. 3, 4 and 5. The foam blocks 30 and 32 may be made of any suitable material such as a closed cell foam of high buoyancy, called ENSOLITE, which is a Coast Guard approved material.

A belt 34 with conventional buckle 36 with cooperating male buckle portion 38 and female buckle portion 40 is secured around the lower portion 4 to permit the floatation device R to be worn around the waist of the individual using it, as best shown in FIGS. 2 and 3. The belt 34 includes a stop 39 that provides an upper limit to the adjustment of the male buckle portion 38 to insure that the device R not properly sized to the user would not be used. The stop 39 also advantageously insures that the slidably adjustable male buckle portion 38 does not accidentally slip out of the belt 34 during a hoisting operation using the belt 34. The stop 39 is made by folding the end of the belt 34 into three layers 41, 43 and 45 with the terminal end 43 of the belt being sandwiched between the two layers 41 and 45 and securing the layers together with box/cross stitching 47 such that a looped portion 49 (also shown in phantom line in a raised position) is left unsecured to the belt to act as a flange to stop the male buckle portion 38 from being removed from the belt, as best shown in FIG. 2(A).

The ends of the upper portion 2 are secured together by a buckle 42 that includes male and female portions 44 and 46, respectively, as best shown in FIGS. 1 and 2.

The chamber 6 is substantially tapered from narrow to wide starting at the midpoint 48 of the device R and extending therefrom towards the opposite ends of the upper portion 2 as best shown in FIGS. 3 and 4. The tapered shape of the chamber 6 advantageously permits the device R to have more buoyancy at the sides and front of the user than at the back, thereby to provide relatively greater tendency to cause the user to be positioned face-up and laid-back in the water.

The flotation device R is preferably made from two overlying, light-weight, flexible, water proof and air-tight sheets 54 and 56, such as coated nylon, as best shown in FIG. 5. The sheets 54 and 56 are secured to each other by welding or other suitable means along exterior edge portions 58, 60, 62 and 64 and along interior seams 66, 68, 70, 72, 74, 76, and 78, as best shown in FIGS. 3, 4 and 5, thereby forming the chambers 6, 8 and 10 with the sheets 54 and 56 forming as walls.

The belt 34 is secured to the material 54 by a plurality of box/cross stitchings 80, as best shown in FIG. 3. Each of the stitchings 80 is isolated and sealed from the respective chambers 8 and 10 by means of a patch 82 made of the same material as the sheets 54 and 56 and sealed to the sheet 54 by welding or other suitable means around perimeter edge 84, as best shown in FIGS. 3 and 5.

In the embodiment where the chambers 8 and 10 are not in communication with the chamber 6, drain holes 86 (shown in phantom lines) in the lower portion 4 may be provided to aid in drying after use.

Figure 6:
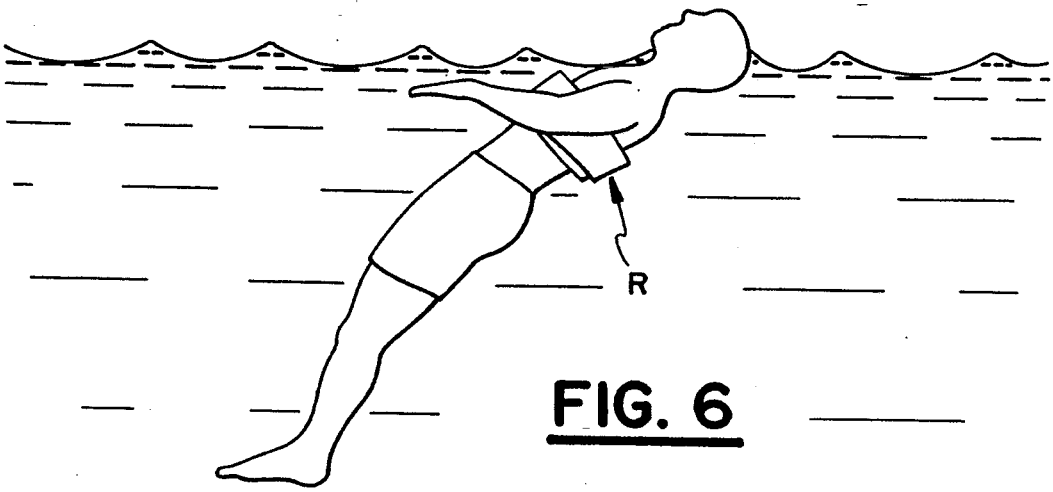
FIG. 6 is a view of the device of FIG. 1 in an uninflated state as worn by a user.

In operation, the personal floatation device R is worn around the waist of the user, as generally depicted in FIG. 6. The device R is fitted to the user such that when worn, the end portions of the device R are substantially close together for proper operation. While in the uninflated state, the upper portion 2 is folder over and outwardly to overly the lower portion 4, as best shown in FIG. 1. In this configuration, the personal floatation device R has minimum width and thickness to provide minimum interference and maximum freedom of movement for the user. The device are secured around the waist by means of the buckle 36 and the belt 34, which is advantageously adjustable in length. The upper portion 2 is also secured together by means of the buckle 42, which is adjustably secured to webbings 88 and 90, as best shown in FIGS. 1 and 3.

Figure 7:
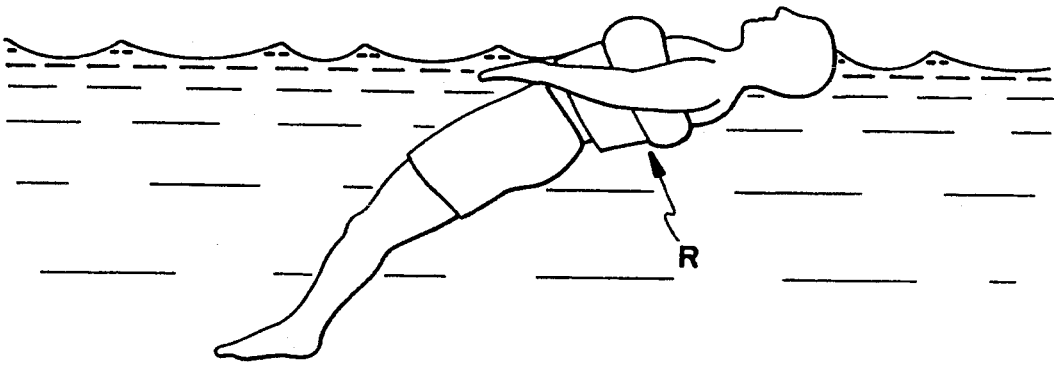
FIG. 7 is a view of the device of FIG. 1 in the inflated state as worn by the user.

During use in the water, the device R, owing to the natural buoyancy of the foam blocks 30 and 32, naturally slips up to the chest area of the user. The device R positions the user in a laid-back face-up position, as best shown in FIGS. 6 and 7. This is accomplished by providing more buoyancy at the sides and front than at the back of the user. The buoyancy chambers 8 and 10 containing the foam blocks 30 and 32 are disposed away from the midpoint 48 of device R such that the foam blocks 30 and 32 are advantageously positioned substantially at the sides and front of the user. In addition, the double tapered shape of the inflatable chamber 6, which is narrower at the midpoint 48 and wider at the outer ends 50 and 52 ensure that more buoyancy is provided to the sides and front of the user than at the back.

Although the device R in the uninflated state can keep the user afloat, additional buoyancy may be provided by inflating the chamber 6 with the gas from the compressed gas bottle 16. The upper portion 2 is unfolded such that it overlies the user's chest area, as best shown in FIG. 7. The valve 18 is activated by pulling the pull tab 20. The compressed gas will inflate the chamber 6. Spaces not occupied by the foam blocks 30 and 32 in the chambers 8 and 10 will also fill with the gas through the passageways 12 and 14, advantageously providing additional buoyancy. The area 91 space defined by the interior seams 62, 72, 76 and 78 in the lower portion 4 between the buoyancy chamber 8 and 10 would advantageously remain uninflated. In case additional air is required, the user may blow into the manual inflation means 23 through the blow tube 26.

For rescue operations, a helicopter hoist cable may be secured to the belt 34 to lift the user from the water. Alternatively, a metal D ring 92 operably secured to the belt 34 may be secured to the helicopter hoist cable. The stop 39 in the belt 34 advantageously insures that the buckle 36 remains secured to the belt 34.

The personal floatation device R is preferably coated on the outside with a urethane coating to prevent ultraviolet light from degrading the material from which the device R is made.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A personal flotation device, comprising:

a) an elongate member for encircling the waist of the user including intermediate and end portions, said intermediate portion being non-buoyant;

b) a buckle for securing together said end portions;

c) said member including an upper elongate inflatable chamber and first and second lower buoyancy chambers; and d) said first and second lower buoyancy portions being spaced apart from each at said intermediate portion such that said first and second lower buoyancy portions are disposed substantially at the sides and front of the user, thereby to cause the user to be positioned in a face-up and laid-back position in the water.

2. A personal flotation device as in claim 1, wherein:

a) said upper elongate inflatable chamber when uninflated and worn around the waist is adapted to be folded over said first and second lower buoyancy chambers.

3. A personal flotation device as in claim 1, wherein:

a) said member includes a valve in communication with said inflatable chamber; and b) a compressed gas bottle operably secured to said valve.

4. A personal flotation device as in claim 1, wherein:

a) said member includes a valve in communication with said inflatable chamber; and b) a tube associated with said valve for permitting the user to blow air into said inflatable chamber.

5. A personal flotation device as in claim 1, wherein:

a) said elongate member comprises a pair of coextensive fabric materials joined together to form therebetween said inflatable chamber and said first and second lower buoyancy chambers.

6. A personal flotation device as in claim 1, wherein:

a) said elongate upper inflatable chamber is tapered from narrow at said intermediate portion to wide at said end portions, thereby to provide substantially greater buoyancy at the sides and front of the user.

7. A personal flotation device as in claim 1, wherein:

a) said first and second lower chambers include first and second inherently buoyant materials, respectively.

8. A personal flotation device, comprising:

a) an elongate member for encircling the waist of a user, said member having intermediate and end portions;

b) a belt operably secured to said member and a buckle for removably securing the ends of said belt;

c) said member including an upper elongate inflatable chamber and first and second lower buoyancy portions;

d) said inflatable chamber when uninflated being adapted to be folded over said first and second lower buoyancy portions;

e) said first and second lower buoyancy portions being spaced apart from each other at said intermediate portion;

f) said first and second lower buoyancy portions being inflatable; and g) said member including passageways communicating between said inflatable chamber and said first and second lower buoyancy portions.

9. A personal flotation device as in claim 8, wherein:

a) said inflatable chamber is tapered from narrow at said intermediate portion to wide at said end portions.

10. A personal flotation device as in claim 8, wherein:

a) said first and second lower buoyancy portions include first and second inherently buoyant materials, respectively.

11. A personal flotation device as in claim 8, and further comprising:

a) a device for inflating said inflatable chamber.

12. A personal flotation device as in claim 11, wherein:

a) said device includes a valve in communication with said inflatable chamber; and b) a compressed gas bottle operably secured to said valve.

13. A personal flotation device as in claim 11, wherein:

a) said device includes a valve in communication with said inflatable chamber; and b) a tube associated with said valve for permitting the user to blow air into said inflatable chamber.

14. A personal flotation device as in claim 8, wherein:

a) said buckle is selectively positionable on said belt, thereby to permit adjustment of the length of said belt; and b) a stop on said belt for being operably associated with said buckle, thereby insuring that said buckle remains secured to said belt.

15. A personal flotation device as in claim 8, wherein:

a) said member includes a pair of opposed walls operably connected to each other;

b) said belt is secured to at least one area of one of said of walls; and c) means for sealing said area.

16. A personal flotation device as in claim 8, and further comprising:

a) a buckle for securing together the end portions of said elongage inflatable chamber.

17. A personal flotation device as in claim 8, wherein:

a) said inflatable chamber and first and second lower buoyancy portions include welded edge portions.

18. A personal flotation device for wearing around the waist of a user in the manner of a belt, comprising:

a) first and second elongate opposed sheets of flexible materials;

b) said sheets being together along their perimeter edges and intermediate the width of said sheets, thereby dividing said sheets into upper and lower portions;

c) said upper portion including an inflatable chamber:

d) said lower portion including first and second buoyancy chambers for being disposed substantially at the sides and front of the user's waist area;

e) said upper portion when uninflated being adapted to be folded over said lower portion;

f) a belt for securing said device around the waist of the user;

g) said first and second sheets being joined together in said lower portion to form said first and second buoyancy chambers; and h) first and second inherently buoyant materially being disposed in said first and second buoyancy chambers, respectively.

19. A personal flotation device as in claim 18, wherein:

a) said inflatable chamber includes passageways into said first and second buoyancy chambers.

* * * * *